US011034544B2

(12) United States Patent
Madera

(10) Patent No.: US 11,034,544 B2
(45) Date of Patent: Jun. 15, 2021

(54) LIFT SYSTEM

(71) Applicant: TK Elevator Innovation and Operations GmbH, Essen (DE)

(72) Inventor: Martin Madera, Neuhausen (DE)

(73) Assignee: TK Elevator Innovation and Operations GmbH, Düsseldorf (DE)

( * ) Notice: Subject to any disclaimer, the term of this patent is extended or adjusted under 35 U.S.C. 154(b) by 210 days.

(21) Appl. No.: 16/076,516

(22) PCT Filed: Feb. 14, 2017

(86) PCT No.: PCT/EP2017/053238
§ 371 (c)(1),
(2) Date: Aug. 8, 2018

(87) PCT Pub. No.: WO2017/140654
PCT Pub. Date: Aug. 24, 2017

(65) Prior Publication Data

US 2019/0047816 A1 Feb. 14, 2019

(30) Foreign Application Priority Data

Feb. 16, 2016 (DE) ..... 10 2016 202 363.2

(51) Int. Cl.
*B66B 1/30* (2006.01)
*B66B 7/00* (2006.01)
(Continued)

(52) U.S. Cl.
CPC ..... *B66B 1/30* (2013.01); *B66B 1/34* (2013.01); *B66B 5/027* (2013.01); *B66B 7/00* (2013.01)

(58) Field of Classification Search
CPC ..... B66B 11/006; B66B 17/14; B66B 17/20
See application file for complete search history.

(56) References Cited

U.S. PATENT DOCUMENTS 1,616,368 A * 2/1927 Harmon ..... B66B 17/20 414/359
3,432,055 A * 3/1969 Guilbert, Jr. ..... B61J 3/06 414/661
(Continued)

FOREIGN PATENT DOCUMENTS

CN 2140360 Y 8/1993
CN 1331654 A 1/2002
(Continued)

OTHER PUBLICATIONS

English Translation of International Search Report issued in PCT/EP2017/053238, dated Jun. 8, 2017 (mailed Jun. 27, 2017).

*Primary Examiner* — Jonathan Snelting
(74) *Attorney, Agent, or Firm* — William J. Cassin

(57) ABSTRACT

An elevator installation may include at least one car that is displaceable in an elevator shaft; a first supply unit for supplying the car with energy, material, and/or data; and an interchange arrangement for interchanging the first supply unit to the car whereby the first supply unit is removed from or attached to the car during ongoing operation of the elevator installation. The interchange arrangement may be configured to remove and/or attached one or more supply units from the car during a regular door-opening cycle where the car stops at a floor of a building in which the elevator installation is installed. A duration of time required to remove the first supply unit from the car, or alternatively add the first supply unit to the car, is less than a duration of time required for a regular door-opening cycle.

12 Claims, 3 Drawing Sheets

(51) Int. Cl.
*B66B 1/34* (2006.01)
*B66B 5/02* (2006.01)

(56) References Cited

U.S. PATENT DOCUMENTS

| | | | | | |
|---|---|---|---|---|---|
| 3,782,563 | A * | 1/1974 | Brockmeyer | B65G 47/57 | 414/659 |
| 3,887,097 | A | 6/1975 | Ach | | |
| 4,148,404 | A * | 4/1979 | Heisler | B66B 11/006 | 414/259 |
| 5,771,995 | A * | 6/1998 | Cooney | B66B 11/006 | 187/357 |
| 6,202,793 | B1 | 3/2001 | Fargo | | |
| 8,863,911 | B2 | 10/2014 | Ecochard | | |
| 2008/0146135 | A1 | 6/2008 | Hein | | |

FOREIGN PATENT DOCUMENTS

| | | | |
|---|---|---|---|
| CN | 1393389 | A | 1/2003 |
| CN | 101146729 | A | 3/2008 |
| CN | 101198539 | A | 6/2008 |
| DE | 2 415 760 | A | 10/1974 |
| DE | 26 18 237 | A | 11/1977 |
| DE | 26 18 237 | C | 1/1987 |
| EP | 1 864 932 | A | 12/2007 |
| EP | 1 272 418 | B | 11/2008 |
| WO | 2009/030260 | A | 3/2009 |
| WO | 2010/031998 | A | 3/2010 |
| WO | 2016/016679 | A | 2/2016 |

* cited by examiner

LIFT SYSTEM

CROSS REFERENCE TO RELATED APPLICATIONS

This application is a U.S. National Stage Entry of International Patent Application Serial Number PCT/EP2017/053238, filed Feb. 14, 2017, which claims priority to German Patent Application No. DE 10 2016 202 363.2, filed Feb. 16, 2016, the entire contents of both of which are incorporated herein by reference.

FIELD

The present disclosure generally relates to elevators, including elevator installations for conveying persons and/or loads.

BACKGROUND

The cars of elevator installations have hitherto been supplied with electrical energy via suspended cables. The electrical energy serves, amongst other things, for illuminating the car and supplying the control device with energy. High-quality elevator installations are provided, in addition, with air-conditioning of the cabins. In the case of very high buildings, the air-conditioning is also combined with a pressure regulation of the cabins. These devices require a very high usage of energy. However, the use of the suspended cables, particularly in very high elevator installations, is problematic by reason of the weight and the tendency to vibrate, so alternatives to the use of the suspended cable are desirable. Sliding contacts have the disadvantage of major wear and emission of noise. As a rule, suspended cables are unsuitable in elevator installations having two or more cars per elevator shaft.

An elevator with an emergency power-supply device is known from EP 1 272 418 B1. The emergency power-supply device comprises an energy-storage unit for electrical energy, which bridges brief drops or interruptions of mains voltage and in the event of failure of the mains supply guarantees the implementation of an evacuation ride to the next stop.

The charging-times of such energy-storage units have hitherto been comparatively lengthy; if the complete energy supply is to be ensured by such energy-storage units without suspended cables and sliding contacts, only the dwell-times at a stop could be used for the purpose of charging. In highly effective elevator installations, however, the dwell-times are minimal and therefore too short as an exclusive opportunity for charging.

Thus a need exists for an alternative concept for cars of elevator installations, one that manages without suspended cables.

DETAILED DESCRIPTION

Figure 1:
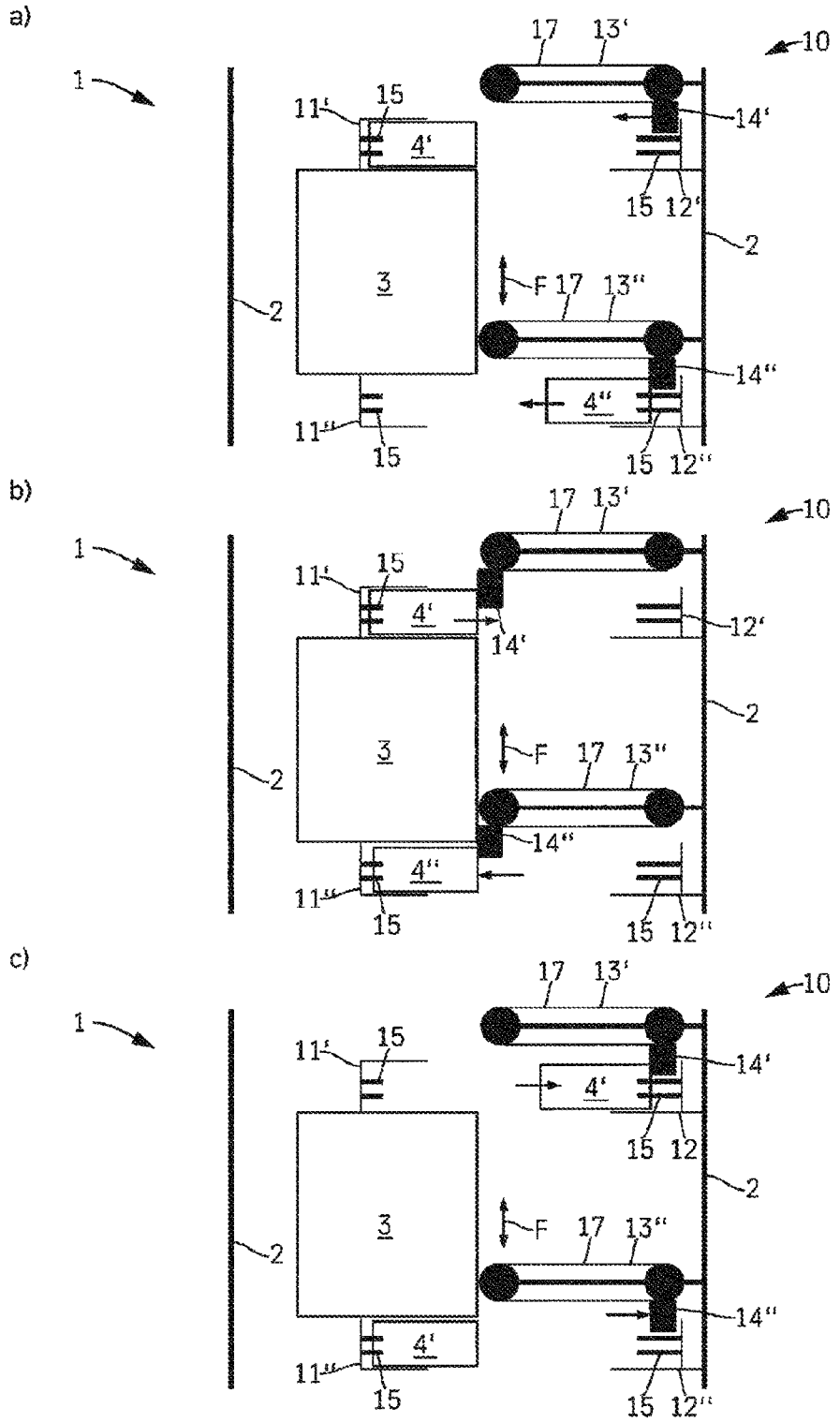
FIG. 1*a* is a schematic view of an example elevator installation in a first configuration in a first situation during translation of a supply unit.
FIG. 1*b* is a schematic view of the example elevator installation in the first configuration in a second situation during the translation of a supply unit.
FIG. 1*c* is schematic view of the example elevator installation in the first configuration in a third situation during the translation of a supply unit.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

Accordingly, an elevator installation includes at least one car which is displaceable in an elevator shaft, in particular several cars which are displaceable in an elevator shaft. In each instance at least one supply unit for supplying the car—in particular with energy, material and/or data—is provided on the car. In accordance with the invention, the elevator installation includes an interchange arrangement which has been set up to carry out a procedure for interchange of the supply unit on the car, namely for removing the supply unit from the car and/or for attaching the supply unit to the car.

Now the essence of the invention consists, in particular, in providing the cars with interchangeable supply units which are removed from the car for the purpose of loading and are loaded, in particular in a fixed loading device. In this case the really short stays at a stop can be utilized merely for the purpose of interchanging the supply units; on the other hand, the procedure for loading the supply units, which takes a longer time, can take place independently of the dwell-time of the car at a stop. Consequently it is possible to transfer large amounts of energy, material or data to the car within a short time. A continuous supply line, for instance by virtue of a suspended cable or by virtue of sliding contacts which are available over the entire travel path, can consequently be dispensed with.

In particular, electrical energy can be stored in the supply unit. Furthermore, the storage of compressed air or cold air by way of material conceivable, with which an air-conditioning system attached to the car is operated. A brake of the elevator cabin can be operated by compressed air. Condensed water from the air-conditioning system can also be conducted away via a supply unit. The attaching of ballast (for example, a counterweight) by way of material can also take place in the proposed manner.

The interchange arrangement preferentially comprises a car unit, a shaft unit and a translation unit. The car unit is firmly attached to the car, and the shaft unit is firmly attached to the elevator shaft. The translation unit has been set up to translate the supply unit between a first position on the car unit and a second position on the shaft unit. The term "elevator shaft" in this connection is to be understood broadly and encompasses substantially all the fixed devices of the elevator installation, in particular a separate machine room or maintenance room.

The translation unit preferentially includes a gripper which has been set up to establish a firm connection between the translation unit and the supply unit. The gripper is displaceable between a first gripper position and a second gripper position. In the first or second gripper position the gripper has in each instance been arranged in such a way that the supply unit fastened thereto is in the first or second position thereof, respectively.

The car unit includes means for removing the energy, the material or the data that has/have been loaded in the supply unit. The shaft unit includes means for loading the supply unit with energy, material or data. This can take place by virtue of a coupling.

The coupling has to be configured in a manner depending on the type of loading. A coupling for electrical energy is, for instance, a plug-in connection or a pressure contact; a compressed-air coupling is suitable for the transfer of compressed air by way of material. For data, use may be made of any hardwired couplings that are suitable for electrical connections.

The interchange arrangement has preferentially been set up that by virtue of the transferring of the supply unit into the first or second position the supply unit is converted into a state in which an exchange of energy, material and/or data with the car unit or with the shaft unit has been made possible.

In this case the interchange arrangement has preferentially been set up to carry out the interchange procedure during ongoing operation of the car. By this, it is meant, in particular, that during the interchange procedure the car can continue to carry out the transportation tasks for conveying persons or loads without a noticeable delay in operation occurring in the process.

The interchange arrangement has preferentially been set up to carry out the interchange procedure during a regular door-opening cycle. In particular in this case, the duration of an interchange procedure is not longer than the minimal duration of a door-opening cycle.

The regular stopping at a stop is utilized for the purpose that, in addition to the boarding and alighting of passengers, the supply unit can also be exchanged. In the case of optimal utilization of the door-opening cycle, no delay consequently arises by virtue of the interchange procedure. The duration of the interchange procedure in this case is defined as the period in which the car is prevented from traveling further by reason of the interchange procedure. The interchange procedure in this case does not necessarily include the complete introduction of the supply unit into a shaft-side loading station.

The removing of a first supply unit from the car preferentially takes place during a first door-opening cycle. The attaching of a second supply unit to the car takes place during a second, subsequent door-opening cycle.

By virtue of the fact that either the removing from the car or the attaching of the supply unit to the car takes place merely within one door-opening cycle, really short door-opening cycles can also make an interchange procedure possible. With such a method it is furthermore preferred that at all tines a (further) supply unit remains on the car, said supply unit ensuring the supply of the car during the intermediate period in which, although the first supply unit has already been removed, the second supply unit has not yet been attached.

In a preferred configuration, the removing of a first supply unit from the car and the attaching of a second supply unit to the car take place during a single door-opening cycle. This has the advantage that after a door-opening cycle unladen supply work has been completely replaced by a laden supply unit. In this connection it is then not absolutely essential that a further supply unit remains on the car in order to ensure the supply during the exchange. A single receiving unit (car unit) for receiving the supply unit on the car may be sufficient.

A stationary supply line has preferably been attached in the elevator shaft, said supply line having been set up to supply the car for the duration of an interchange procedure. In particular, if only one car unit has been provided, this may have the consequence that no supply unit has been arranged on the car during the interchange procedure. For this period the stationary supply line ensures the appropriate supply of the car.

The features of the dependent claims may find application, reformulated where appropriate, in a claim relating to a method for operating or controlling an elevator installation as disclosed in the claims or in the description, and also for using such an elevator installation.

The invention further relates to a method for controlling an elevator installation, in particular an elevator installation of the aforementioned type. The elevator installation includes at least one, in particular several cars which are displaceable in an elevator shaft. At least one supply unit for supplying the car—in particular with energy, material and/or data—is attached to the car. A destination stop is assigned on the basis of a control program, taking user inputs to a car into consideration. When the car passes this destination stop, the car is decelerated there, so that, in particular, persons can enter or leave the car at this destination stop. In accordance with the invention, the assigning of a stop as destination stop now takes place while taking the loading-state of the supply unit into consideration. The assigning as destination stop preferentially furthermore takes place while taking free loading capacities at this stop into consideration.

In particular, the shaft unit at which the supply unit can be loaded is located at a destination stop. In the case where the supply unit has been unloaded in a short time, a speedy interchange procedure is required. In one configuration of the invention, a check is now made as to which stop is provided with an interchange device, the shaft unit of which is currently ready for the accommodation of an unladen supply unit. Once such a stop has been ascertained, it can be established as a destination stop which will be approached by the car in the course of the next pass. An interchange procedure is then carried out. To this extent, this destination stop is equated to other stops that, by reason of a user input, were established as destination stop and are to be approached by the car.

FIG. 1*a* shows a first elevator installation 1 according to the invention. Said elevator installation includes a car 3 which is displaceable in an elevator shaft, represented here by two shaft walls 2, along a vertical travel path F. For the purpose of supplying with electrical energy, a first and a second supply unit 4', 4" have been attached to the car 3. The exchange of electrical energy from the respective supply unit 4', 4" to the car 3 takes place in each instance via a coupling 15. In traveling operation, the electrical energy is used for illumination or for control purposes. The drive of the elevator is brought about via a linear drive which is not represented.

The energy stored in the supply units is finite. For the purpose of charging the supply units, the latter are removed from the car 3 and transferred in fixed charging stations on the elevator shaft. For this purpose the elevator installation 3 comprises an interchange arrangement 10.

The interchange arrangement 10 comprises a first and a second car unit 11', 11", which are respectively attached to the car 3 and can respectively receive a supply unit 4', 4". The supply units 4 supply the car 3 with energy via the couplings 15 already mentioned. The first car unit 11' is arranged above the cabin of the car 3; the second car unit 11" is arranged below the cabin of the car 3, other types of arrangement being readily possible.

The interchange arrangement 10 includes a first and a second translation unit 13', 13" for translating the first and second supply units 4', 4", respectively, from the first and second car units 11', 11", respectively, to a corresponding first and second shaft unit 12', 12", respectively, which are attached to the elevator shaft 2. The shaft units constitute the charging stations; the supply unit 4 is supplied with electrical energy for charging via a coupling 15 to the shaft unit 12', 12".

The first and second translation units 13', 13" respectively comprise a first and second gripper 14', 14" which are respectively displaceable between a first gripper position, facing toward the car unit 11, and a second gripper position, facing toward the shaft unit 12. FIG. 1*a* shows the two grippers 14, in each instance in the second gripper position thereof.

During the operation of the elevator installation 10 a supply unit 4 has been attached to at least one of the car units 11 in each operating state; in FIG. 1*a* the first supply unit 4' has been attached to the first car unit 11'. An interchange procedure is initiated in timely manner before the first supply unit 4' has stored any energy. For this purpose, the car 3 firstly arrives at a stop which is equipped with an interchange arrangement 10 according to the invention. Unnoticed by the passengers who are leaving or entering the car 3, the first supply unit 4' is exchanged for a second supply unit 4". The first gripper 14 now travels into the first gripper position thereof (FIG. 1*b*) and grips the first supply unit 4' attached to the car unit 11, as a result of which a firm connection between the first gripper 14' of the first supply unit 4' is established. Substantially at the same time, by shifting the second gripper 14" the interchange arrangement 10 brings the second supply unit 4" out of the second position thereof on the second shaft unit 12" into the first position thereof on the second car unit 11". By virtue of linkage with the aid of the coupling 15, an energy-transferred connection between the second supply unit 4" and the second car unit 11" is established, so that the car 3 is now supplied by the second supply unit 4".

Subsequently the unladen first supply unit 4' is detached from the first car unit 11' and transferred to the first shaft unit 12' (FIG. 1*c*). The first supply unit 4' is loaded there while the car simultaneously leaves the stopping station, following the travel path F.

FIG. 2*a* shows a second elevator installation 1 according to the invention, which largely corresponds to the elevator installation according to FIG. 1; in the following, only the differences will be considered.

Only one car unit 11 is arranged on the car 3. In addition, interchange arrangement 10 includes only one translation unit 13 with a gripper 14. First of all, the the first supply unit 4' is removed from the car unit 11 by the translation unit 13 and subsequently transferred into the free first shaft unit 12' (FIG. 2*b*). Subsequently the gripper 14 travels to the second shaft unit 12" and grips the second, loaded supply unit 4" there and takes it to the car unit 11 (FIG. 2*c*). The translation unit 13 in this case is displaceable along the shaft 2 and can consequently serve both shaft units 12.

Since only one car unit 11 is provided, in a short intermediate period no supply unit 4 has been attached to the car 3. In this intermediate period the energy supply is ensured via a stationary supply line 16. A contacting can take place, for instance, via a sliding contact.

Figure 2:
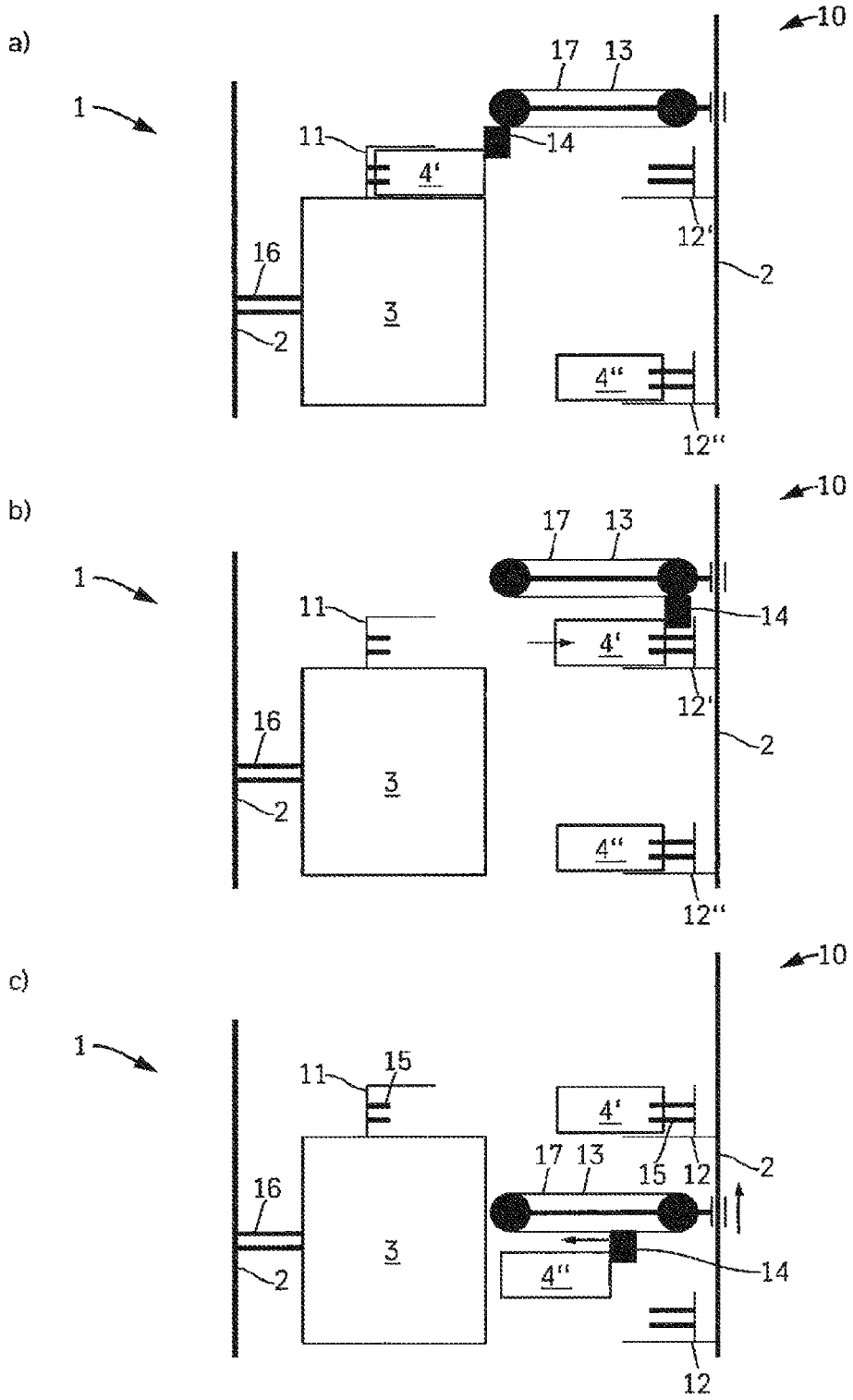
FIG. 2*a* is a schematic view of an example elevator installation in a second configuration in a first situation during translation of a supply unit.
FIG. 2*b* is a schematic view of the example elevator installation of FIG. 2*a* in the second configuration in a second situation during the translation of a supply unit.
FIG. 2*c* is a schematic view of the example elevator installation of FIG. 2*a* in the second configuration in a third situation during the translation of a supply unit.

In the configurations shown in FIGS. 1 and 2, the translation unit 13 comprises a belt conveyor 17 and the gripper 14 attached thereto. In the following figures, alternative translation units will be presented which can be employed in the elevator installations shown in FIGS. 1 and 2.

Figure 3:
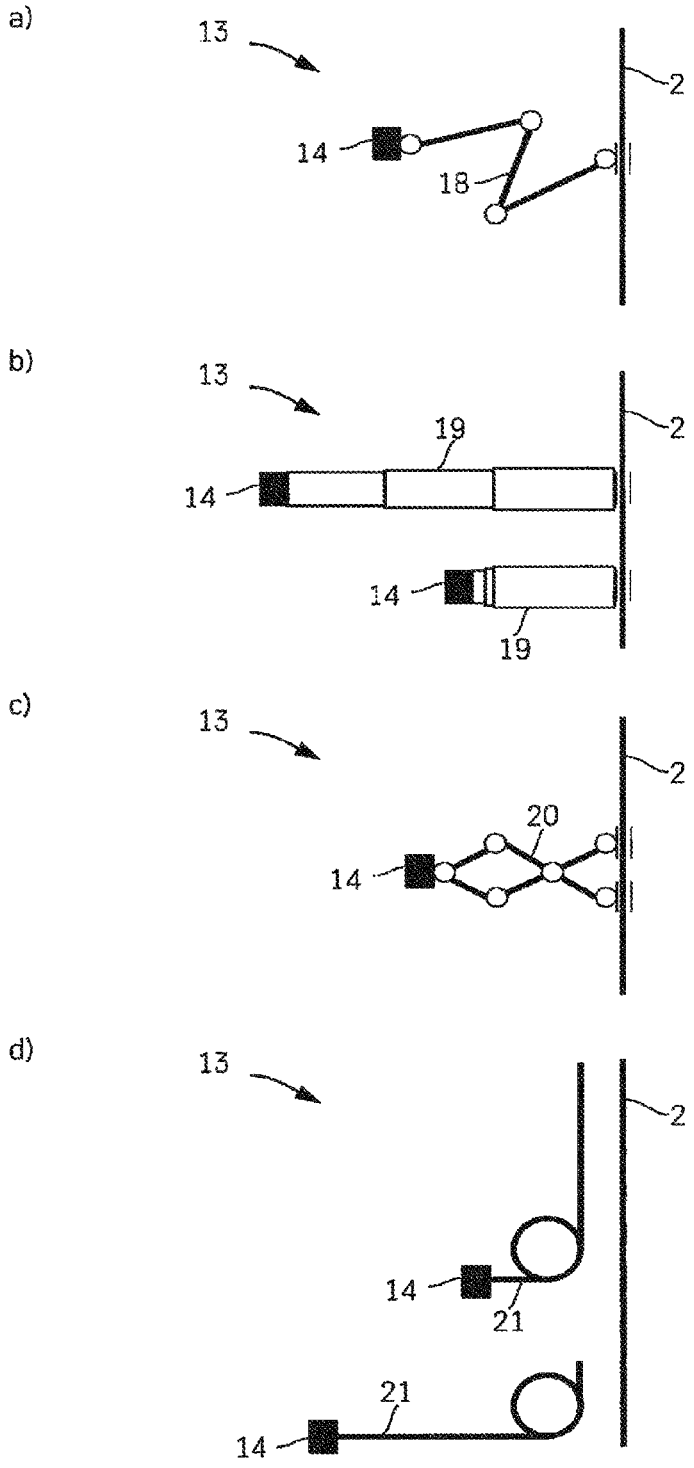
FIG. 3*a* is a schematic view of an example translation unit that includes an example multi-jointed robot arm.
FIG. 3*b* is a schematic view of another example translation unit that includes an example extensible telescopic arm.
FIG. 3*c* is a schematic view of still another example translation unit that includes an example extensible scissors arm.
FIG. 3*d* is a schematic view of still another example translation unit that includes an example rigid-back chain.

FIG. 3*a* shows a translation unit 13 which includes a multi-jointed robot arm 18, at the end of which the gripper 14 is attached. Shown is an intermediate position of the gripper 14 between the first and the second gripper position.

FIG. 3*b* shows a translation unit 13 which includes an extensible telescopic arm 19, at the end of which the gripper 14 is attached. Shown are the first gripper position (FIG. 3*b*, top) and the second gripper position (FIG. 3*b*, bottom).

FIG. 3*c* shows a translation unit 13 which includes an extensible scissors arm 20, at the end of which the gripper 14 is attached. Shown is an intermediate position of the gripper 14 between the first and the second gripper position.

FIG. 3*d* shows a translation unit 13 which includes a rigid-back chain 21, at the end of which the gripper 14 is attached. Such a chain is basically described in DE 20 2012 001 762 U1 and is often employed in connection with the automatic actuation of windows. Shown are the second gripper position (FIG. 3*b*, top) and the first gripper position (FIG. 3*b*, bottom).

LIST OF REFERENCE SYMBOLS

1 elevator installation
2 elevator shaft/shaft wall
3 car
4 supply unit
10 interchange arrangement
11 car unit
12 shaft unit
13 translation unit
14 gripper
15 coupling
16 supply line
17 belt conveyor
18 robot arm
19 telescopic arm
20 scissors arm
21 rigid-back chain
F direction of travel

What is claimed is:

1. An elevator installation comprising:

a plurality of cars that are displaceable in an elevator shaft, each car comprising at least one of an illumination device, a control device, an air conditioning system, or a linear drive;

a supply unit for each of the plurality of cars that is configured to supply electrical energy to the at least one of the respective illumination device, the control device, the air-conditioning system, or the linear drive without use of either suspended cables or sliding contacts; and an interchange arrangement configured to exchange the supply units for each of the plurality of cars by at least one of removing the supply units from the cars or attaching the supply units to the cars.

2. The elevator installation of claim 1 wherein the interchange arrangement is configured to perform the procedure during ongoing operation of the cars.

3. The elevator installation of claim 1 wherein the interchange arrangement is configured to remove one of the supply units from one of the cars during a regular door-opening cycle.

4. The elevator installation of claim 1 wherein the interchange arrangement is configured to attach one of the supply units to one of the cars during a regular door-opening cycle.

5. The elevator installation of claim 1 wherein a duration of time required to remove one of the supply units from one of the cars is less than a duration of time required for a regular door-opening cycle.

6. The elevator installation of claim 1 wherein a duration of time required to attach one of the supply units to one of the cars is less than a duration of time required for a regular door-opening cycle.

7. The elevator installation of claim 1 wherein the interchange arrangement is configured to remove a first of the supply units from a first of the cars during a first door-opening cycle, wherein the interchange arrangement is configured to attach a second of the supply units to the first of the cars during a second door-opening cycle, wherein removing the first of the supply units requires less time than the first door-opening cycle, wherein attaching the second of the supply units requires less time than the second door-opening cycle.

8. The elevator installation of claim 1 wherein the interchange arrangement is configured to remove a first of the supply units from a first of the cars and attach a second of the supply units to the first of the cars during a single door-opening cycle of the first of the cars, wherein removing the first of the supply units and attaching the second of the supply units requires less time than the single door-opening cycle.

9. The elevator installation of claim 1 comprising a stationary supply line attached to the elevator shaft, wherein the stationary supply line is configured to supply a first of the cars for a duration of an interchange procedure performed with respect to the first of the cars.

10. The elevator installation of claim 1 wherein the interchange arrangement comprises:

a car unit that is attached to a first of the cars;

a shaft unit that is attached to the elevator shaft; and a translation unit configured to translate a first of the supply units between a first position on the car unit and a second position on the shaft unit.

11. The elevator installation of claim 10 wherein the translation unit comprises a gripper configured to establish a connection between the translation unit and the supply unit, the gripper being displaceable between a first gripper position and a second gripper position.

12. The elevator installation of claim 11 wherein the interchange arrangement is configured such that transferring the supply unit into the first position or the second position converts the supply unit into a state in which the supply unit can exchange the at least one of energy, material, or data with the car unit or the shaft unit.

* * * * *